US006085065A

United States Patent [19]

Ando

[11] Patent Number: 6,085,065

[45] Date of Patent: Jul. 4, 2000

[54] IMAGE FORMING APPARATUS PROVIDED WITH A RE-SUPPLY STACKING MEANS

[75] Inventor: Eiichi Ando, Abiko, Japan

[73] Assignee: Canon Kabushiki Kaisha, Tokyo, Japan

[21] Appl. No.: 09/047,223

[22] Filed: Mar. 25, 1998

[30] Foreign Application Priority Data

Mar. 26, 1997 [JP] Japan ..... 9-073231

[51] Int. Cl.[7] ..... G03G 15/00

[52] U.S. Cl. ..... 399/402; 271/3.03; 271/3.13

[58] Field of Search ..... 399/393, 401, 399/402; 271/3.02, 3.03, 3.13

[56] References Cited

U.S. PATENT DOCUMENTS

| | | | |
|---|---|---|---|
| 4,873,547 | 10/1989 | Sasaki et al. | 399/402 |
| 4,978,111 | 12/1990 | Kosugi et al. | 271/3.02 |
| 4,995,601 | 2/1991 | Ohashi et al. | 271/127 |
| 5,008,713 | 4/1991 | Ozawa et al. | 399/402 |
| 5,023,658 | 6/1991 | Toyama et al. | 355/72 |
| 5,023,669 | 6/1991 | Hatano et al. | 399/402 |
| 5,040,784 | 8/1991 | Akashi | 271/3.03 X |
| 5,090,674 | 2/1992 | Ozawa | 271/3.03 |
| 5,093,690 | 3/1992 | Ohno et al. | 399/402 |

*Primary Examiner*—Fred L Braun

*Attorney, Agent, or Firm*—Fitzpatrick, Cella, Harper & Scinto

[57] ABSTRACT

An image forming apparatus has a re-supply stacker for reversing a front surface and a rear surface of a sheet and temporarily stacking sheets so that a sheet having one surface on which an image was formed by an image forming unit is re-supplied to the image forming unit, a sheet conveyer for reversing a front surface and a rear surface of a sheet and conveying the sheet to the re-supply stacker, a shifter for shifting the sheet discharged from the sheet conveyer onto the re-supply stacker to abut the sheet against a regulation unit for regulating a position of the sheet, and a controller for controlling so that a shift amount of the shifter is changed.

12 Claims, 13 Drawing Sheets

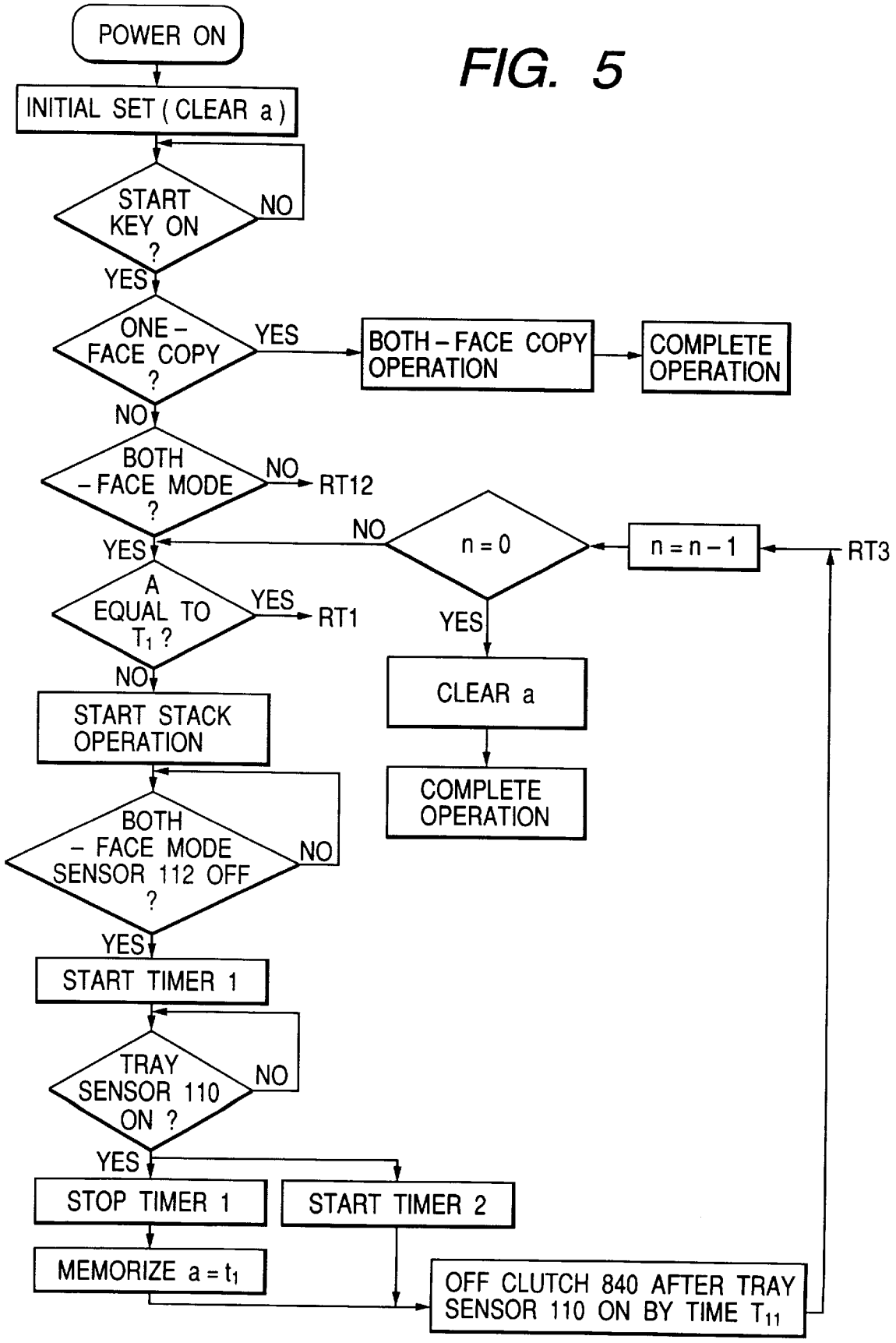
FIG. 5
POWER ON
INITIAL SET ( CLEAR a )
START KEY ON ?
NO
YES
ONE - FACE COPY ?
YES
BOTH - FACE COPY OPERATION
COMPLETE OPERATION
NO
BOTH - FACE MODE ?
NO
RT12
YES
NO
n = 0
n = n - 1
RT3
A EQUAL TO $T_1$ ?
YES
RT1
YES
CLEAR a
NO
START STACK OPERATION
COMPLETE OPERATION
BOTH - FACE MODE SENSOR 112 OFF ?
NO
YES
START TIMER 1
TRAY SENSOR 110 ON ?
NO
YES
STOP TIMER 1
START TIMER 2
MEMORIZE $a = t_1$
OFF CLUTCH 840 AFTER TRAY SENSOR 110 ON BY TIME $T_{11}$

IMAGE FORMING APPARATUS PROVIDED WITH A RE-SUPPLY STACKING MEANS

BACKGROUND OF THE INVENTION

1. Field of the Invention

The present invention relates to an image forming apparatus such as a copying machine, a printer, a facsimile and the like.

2. Related Background Art

Some image forming apparatuses such as copying machines, printers and facsimiles have a multi-mode in which plural image forming operations are effected regarding a single sheet and a both-face mode in which image forming operations are effected regarding both surfaces of each sheet. In the multi-mode and the both-face mode, sheets on which images were formed are temporarily stacked on an intermediate tray in the image forming apparatus, and then, each sheet is re-supplied from the intermediate tray to an image forming portion. In this case, the sheet first image formation of which was finished in the multi-mode is placed on the intermediate tray with an imaged surface facing downwardly; whereas, the sheet first image formation of which was finished in the both-face mode is rested on the intermediate tray with an imaged surface facing upwardly.

FIG. 11 shows a conventional image forming apparatus (copying machine) 100B having a multi-mode and a both-face mode.

The image forming apparatus 100B is provided with a plurality of sheet supply cassettes 1 to 4 of front loading type. Sheets S1 to S4 having different sizes are contained in the sheet supply cassettes 1 to 4. For example, the sheets S1 having A5 size or statement size are stacked and contained in the cassette 1, the sheets S2 having A4 size, B5 size or letter size are stacked and contained in the cassette 2, the sheets S3 having A4R size, B5R size or letter R size are stacked and contained in the cassette 3, and the sheets S4 having B4 size or legal size are stacked and contained in the cassette 4.

In the image forming apparatus 100B, the sheets S1 to S4 in the sheet supply cassettes 1 to 4 are selectively supplied. The sheets S1 to S4 stacked and contained in the sheet supply cassettes 1 to 4 are supplied one by one from an uppermost sheet by means of respective sheet supply rollers 5 rotated in an ant-clockwise direction in FIG. 11. The sheets S fed out by the corresponding sheet supply roller 5 are separated by a pair of separation rollers 6 so that only the uppermost sheet is sent to a pair of register rollers 13 (which are now stopped) through convey rollers 7 to 12.

The convey rollers 7 to 11 convey the sheet S until a predetermined loop is formed in the sheet after a tip end of the sheet abuts against a nip between the pair of register rollers 13. By forming such a loop, skew-feed of the sheet S is corrected.

An electrostatic latent image is formed on a photosensitive drum (electrophotographic photosensitive member) 14 rotated in a clockwise direction in FIG. 11, by an exposure means utilizing a laser beam, and the latent image is developed with developer (toner) from a developing means to form a toner image. The sheet S (skew-feed of which was corrected) is sent to a transfer station between the photosensitive drum (image bearing member) 14 and a transfer charger (transfer means) 15, by the pair of register rollers 13 which start to be rotated at a timing for aligning the tip end of the sheet with the toner image. While the sheet is passing through the transfer station, the toner image on the photosensitive drum 14 is transferred onto the sheet by the transfer charger 15.

The sheet S to which the toner image was transferred is sent to a pair of fixing rollers 17 by a convey belt 16. While the sheet is passing through between the pair of fixing rollers 17, the toner image is fixed to the sheet by heat and pressure.

Thereafter, the sheet S is conveyed by a pair of convey rollers 18. In a normal mode, the sheet is sent to a pair of discharge rollers 20 through a sheet discharge path 19 and then is discharged onto a sheet discharge tray 21 out of the apparatus by the pair of discharge rollers 20. In the normal mode, as shown by the solid line, a flapper 22 opens the sheet discharge path 19 and opens a vertical path 23.

In a multi-mode or both-face mode, the sheet S conveyed by the pair of convey rollers 18 is sent to the vertical path 23 communicating with an intermediate tray 29. In this case, the flapper 22 is shifted to a position as shown by the broken line to close the sheet discharge path 19 and open the vertical path 23.

Explaining with reference to FIGS. 11, 12A, 12B and 12C, in the multi-mode, the sheet S sent into the vertical path 23 is sent to a convey-in path 27 by pairs of convey rollers 24 to 26 and then is sent to a discharge path 60 above the intermediate tray 29 by a pair of convey-in rollers 28. Then, the sheet S is discharged onto the intermediate tray 29 from one of pairs of discharge rollers 61 to 64 disposed in the discharge path 60 along a sheet conveying direction, with an imaged surface of the sheet facing downwardly.

When a sheet S having a maximum size in the sheet conveying direction is used, in accordance with the sheet size, a first flapper 66 is rotated upwardly, thereby discharging the sheet S from a discharge opening 41. When a sheet S having second large size is used, a second flapper 67 is rotated upwardly thereby discharging the sheet S from the first pair of discharge rollers 61. When a sheet S having third large size is used, a third flapper 68 is rotated upwardly to thereby discharge the sheet S from the second pair of discharge rollers 62. When a sheet S having fourth large size is used, a fourth flapper 69 is rotated upwardly, thereby discharging the sheet S from the third pair of discharge rollers 63. When a sheet S having smallest size is used, a fifth flapper 70 is rotated upwardly, thereby discharging the sheet S from the fourth pair of discharge rollers 64 (refer to FIG. 12A).

As shown in FIGS. 12B and 12C, the sheet discharged on the intermediate tray 29 is conveyed by an auxiliary roller 71 rotated in an anti-clockwise direction until the tip end of the sheet abuts against a rotatable shutter 44 which is now cocked. In this case the tip end of the sheet is guided by a movable sheet guide 72 to suppress a curl. The auxiliary roller 71 is positioned at an upper waiting position when the sheet is discharged to permit the discharging of the sheet and, immediately after the sheet was discharged, the roller 71 is lowered to convey the sheet S. The movable sheet guide 72 is provided with an opening through which the auxiliary roller 71 can be lifted and lowered.

The sheets S stacked on the intermediate tray 29 are fed from an uppermost one by the auxiliary roller 71 rotated in the anti-clockwise direction in FIG. 11. In this case, the auxiliary roller 71 is lowered from the waiting position shown by the solid line to a position shown by the broken line to convey the sheet S. The movable shutter 44 is laid toward an inclined condition to guide the supplied sheet S to a nip of a pair of separation rollers 47. A side guide 80 shiftable in accordance with the size of the sheet S is provided on the intermediate tray 29 to prevent the skew-feed of the sheet.

The sheets S fed by the auxiliary roller 71 are separated by the pair of separation rollers 47 so that only the uppermost sheet is conveyed to the pair of regist rollers 13 (which are now stopped) by the pair of convey rollers 9 to 12. Further, a detection means 81 for detecting presence/absence of the sheet S is provided on the intermediate tray 29. By detecting the absence of the sheet S after the re-supply of the sheet is finished, the double-feed of the sheets is checked.

Explaining with reference to FIG. 11, in the both-face mode, the sheet S sent into the vertical path 23 is sent to the convey-in path 27 by the pairs of convey rollers 24 to 26 and then is sent to the discharge path 60 by the pair of convey-in rollers 28. In this both-face mode, all of the flappers 66 to 70 in the discharge path 60 were rotated downwardly. The sheet S sent into the discharge path 60 is conveyed to a terminal U-turn portion 73 by the pair of discharge rollers 61 to 65 and then is discharged onto the intermediate tray 29 by a discharge roller 74 and a discharge sub-roller 75, with an imaged surface of the sheet facing upwardly. In this case the tip end of the sheet is guided by the movable sheet guide 72 set to an inclined condition as shown by the solid line to suppress the curl.

The sheet discharged on the intermediate tray 29 is conveyed by the auxiliary roller 71 rotated in the anti-clockwise direction in FIG. 11 until the tip end of the sheet abuts against the rotatable shutter 44 which is not cocked. In this case, the tip end of the sheet is guided by the movable sheet guide 72 set to the inclined condition as shown by the solid line to suppress the curl. The auxiliary roller 71 is positioned at the upper waiting position when the sheet is discharged to permit the discharging of the sheet, and, immediately after the sheet was discharged, the roller 71 is lowered to convey the sheet S. Similar to the multi-mode, the sheets S stacked on the intermediate tray 29 are successively re-supplied toward the pair of regist rollers 13 from an uppermost one. Incidentally, while the sheet is being dropped toward the intermediate tray 29, the auxiliary roller 71 is lowered from the waiting position, thereby forcibly urging the sheet against the intermediate tray 29.

However, in the above-mentioned conventional example, both in the both-face mode and multi-mode, when the sheet S discharged on the intermediate tray is urged against the shutter 44 by the auxiliary roller 71, the sheet is stopped by stopping the rotation of the auxiliary roller 71 or separating the auxiliary roller from the sheet S. In the conventional technique, a timing for stopping the sheet is selected as a fixed value determined by the sheet size in the multi-mode or as a uniform fixed value in the both-face mode. In this arrangement, the dropped position of the sheet is varied due to unevenness (between apparatuses) in response to a shifting speed and a shift start timing of a means for abutting the auxiliary roller 71 against the sheet S, and the dropped position is also varied due to the change in the response and the shifting speed caused by the change in environment and endurance. Further, since the curl in the sheet is greatly changed in accordance with the kind of the sheet and the environment and since the resiliency of the sheet is changed in accordance with the kind of the sheet, the flying speed of the sheet is changed by such factors, thereby changing the dropped position of the sheet.

Further, the position of the auxiliary roller 71 stopped on the intermediate tray with the interposition of the sheets is changed in accordance with the number of sheets stacked on the intermediate tray. Further, the distance through which the sheet is conveyed by the auxiliary roller 71 is changed due to unevenness in a diameter and a coefficient of friction of the auxiliary roller 71 and due to change in such factors during time lapse. Thus, the following problems arise.

Since the auxiliary roller 71 has a conveying force sufficient to surely convey the sheet S to the pair of convey rollers 47, if the sheet S is further conveyed after the sheet S reaches the movable shutter 44 due to the unevenness in the dropped position of the sheet S and/or the unevenness in a conveying distance of the auxiliary roller 71, the sheet S is buckled to generate a folding line in the sheet. Further, when the buckling of the sheet S is released by separating the auxiliary roller 71 from the sheet S, the sheet is flying away from the movable shutter 44, thereby causing mis-alignment of the sheets on the intermediate tray.

In addition, even if the buckling is not generated, in the both-face mode, since the auxiliary roller 71 is slid on the imaged surface of the sheet S, the image is distorted and/or the auxiliary roller 71 is contaminated, with the result that further sheets are contaminated by the auxiliary roller. Further, if the sheet S does not reach the movable sheet 44 due to the unevenness in the dropped position of the sheet S and/or the unevenness in the conveying distance of the auxiliary roller 71, the mis-alignment of the sheets will occur.

SUMMARY OF THE INVENTION

An object of the present invention is to reduce fluctuation of a stopped position of a sheet after sheet supply caused by influence due to unevenness in a dropped position of the sheet generated by unevenness (between apparatuses) in response of a shifting speed and a shift start timing of an auxiliary roller, time lapse change and environmental change in such factors, the degree of curl and resiliency of the sheet and the number of sheets already stacked, and due to unevenness (between apparatuses) in a diameter and a coefficient of friction of the auxiliary roller and change in such factors during time lapse. Another object of the present invention is to prevent folding of the sheet due to buckling, mis-alignment of sheets and contamination of the sheet by achieving the above object.

The present invention provides an image forming apparatus comprising a re-supply stacking means for temporarily stacking sheets on a way that a sheet on the surface of which an image was formed by an image forming means is re-supplied to the image forming means, a sheet convey means for conveying the sheet to the re-supply stacking means, a shift means for shifting the sheet discharged from the sheet convey means onto the re-supply stacking means to abut the sheet against a regulation means for regulating a position of the sheet, and a control means for controlling so that a shift amount of the shift means is changed.

BRIEF DESCRIPTION OF THE DRAWINGS

FIGS. 5, 6, 7 and 8 are flow charts regarding the preferred embodiment;

DETAILED DESCRIPTION OF THE REFERRED EMBODIMENTS

Figure 11:
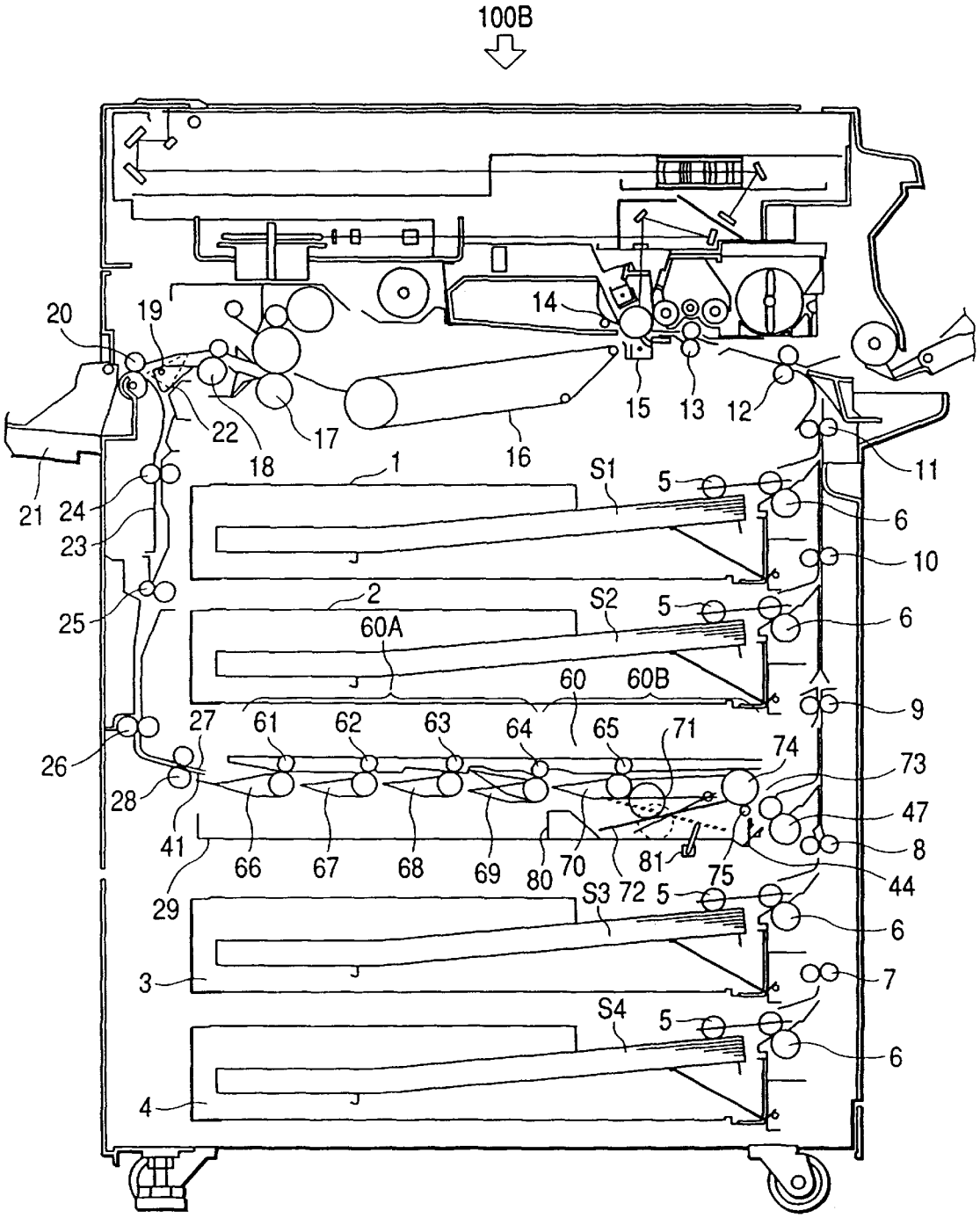
FIG. 11 PRIOR ART
FIG. 11 is a sectional view of a conventional image forming apparatus.
Figure 12A:
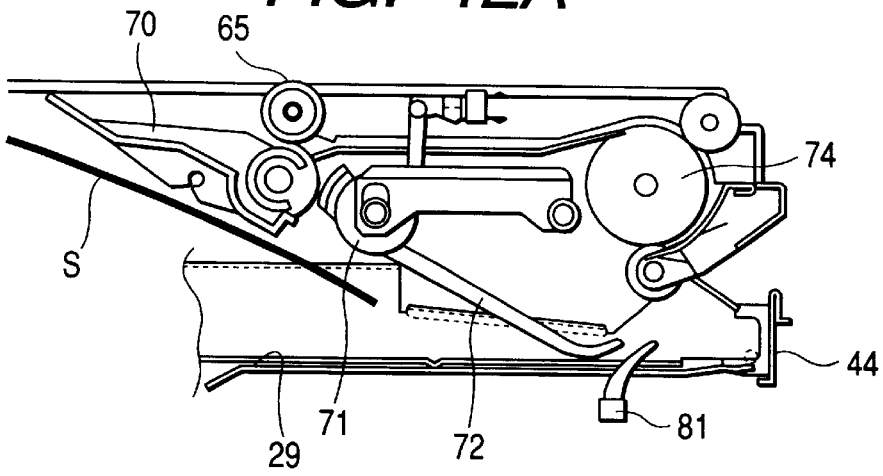
FIGS. 12A, 12B and 12C are views showing conditions that a sheet is discharged onto an intermediate tray.
Figure 12B:
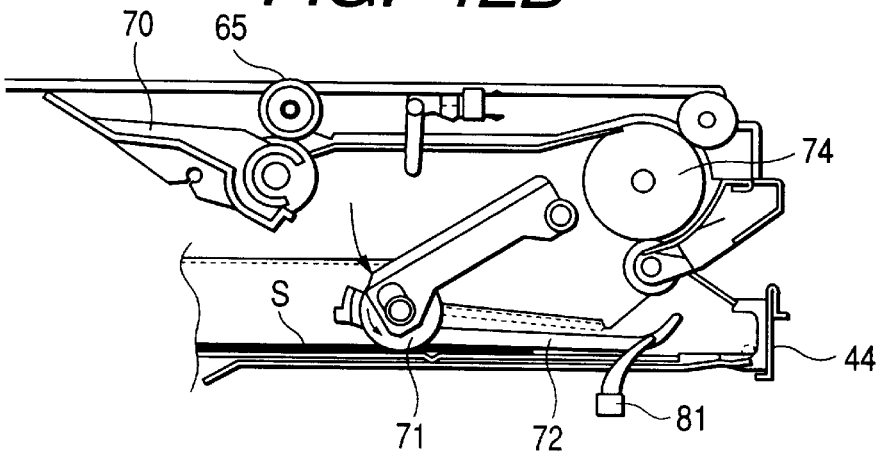
Figure 12C:
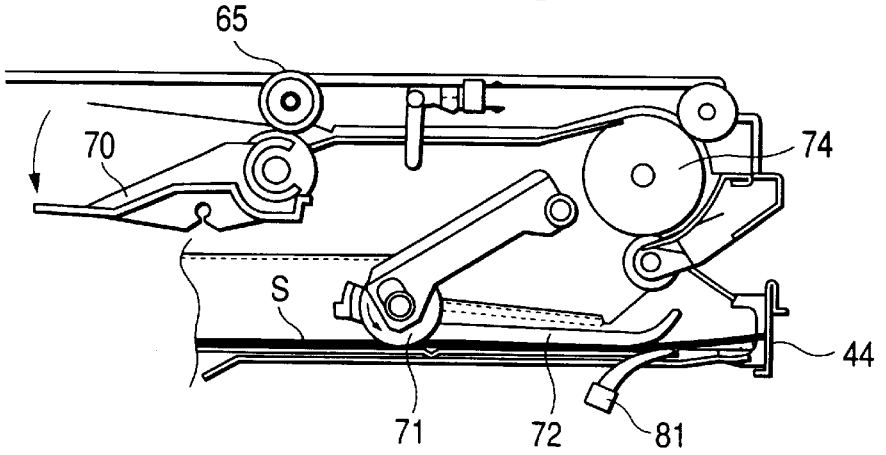

An image forming apparatus according to the present invention has the same construction as that of the above-mentioned conventional image forming apparatus 100B shown in FIG. 11 except for some differences. Accordingly, only the differences will be described. Further, the same elements are designated by the same reference numerals.

Figure 1:
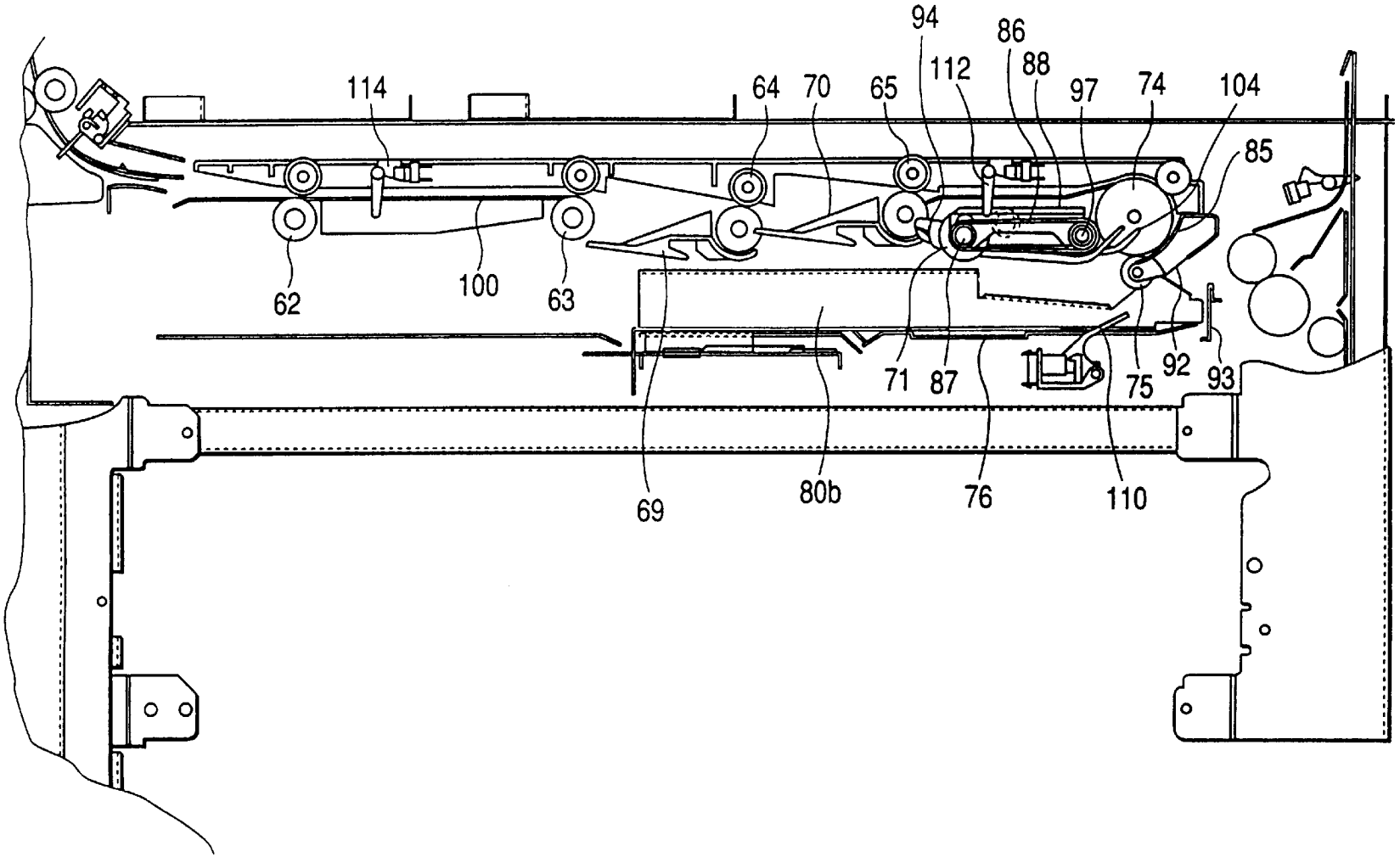
FIG. 1 is an elevational sectional view showing a main portion of an image forming apparatus according to a preferred embodiment of the present invention.

In FIG. 1, a movable guide 104 is pivotally supported by a sheet supply roller shaft 87 for supporting a sheet supply roller 71 which may serve as shift means. The sheet supply roller shaft 87 is rotatably supported by an arm plate 88 which is pivotally supported by a drive shaft 97.

A timing belt 86 serves to transmit rotation of the drive shaft 97 to the sheet supply roller shaft 87. The reference numeral 74 denotes a U-turn roller; 85 denotes a U-turn guide; 80*a*, 80*b* denote side guides; 75 denotes a discharge sub-roller; 92 denotes a pressurizing spring for urging the discharge sub-roller against the U-turn roller 74; 94 denotes a pressurizing lever biased in an anti-clockwise direction and supported by a lower guide 100; 76 denotes a bottom plate on which sheets are stacked and which may serve as re-supply stacking means; and 93 denotes an open/close shutter, which may serve as a regulation means. A multi-mode sensor 114 is disposed at an upstream side of a flapper 69 and a both-face mode sensor 112 is disposed at an upstream side of the U-turn roller 74. A tray sensor 110 serves to detect presence/absence of the sheet on an intermediate tray 29.

Figure 2:
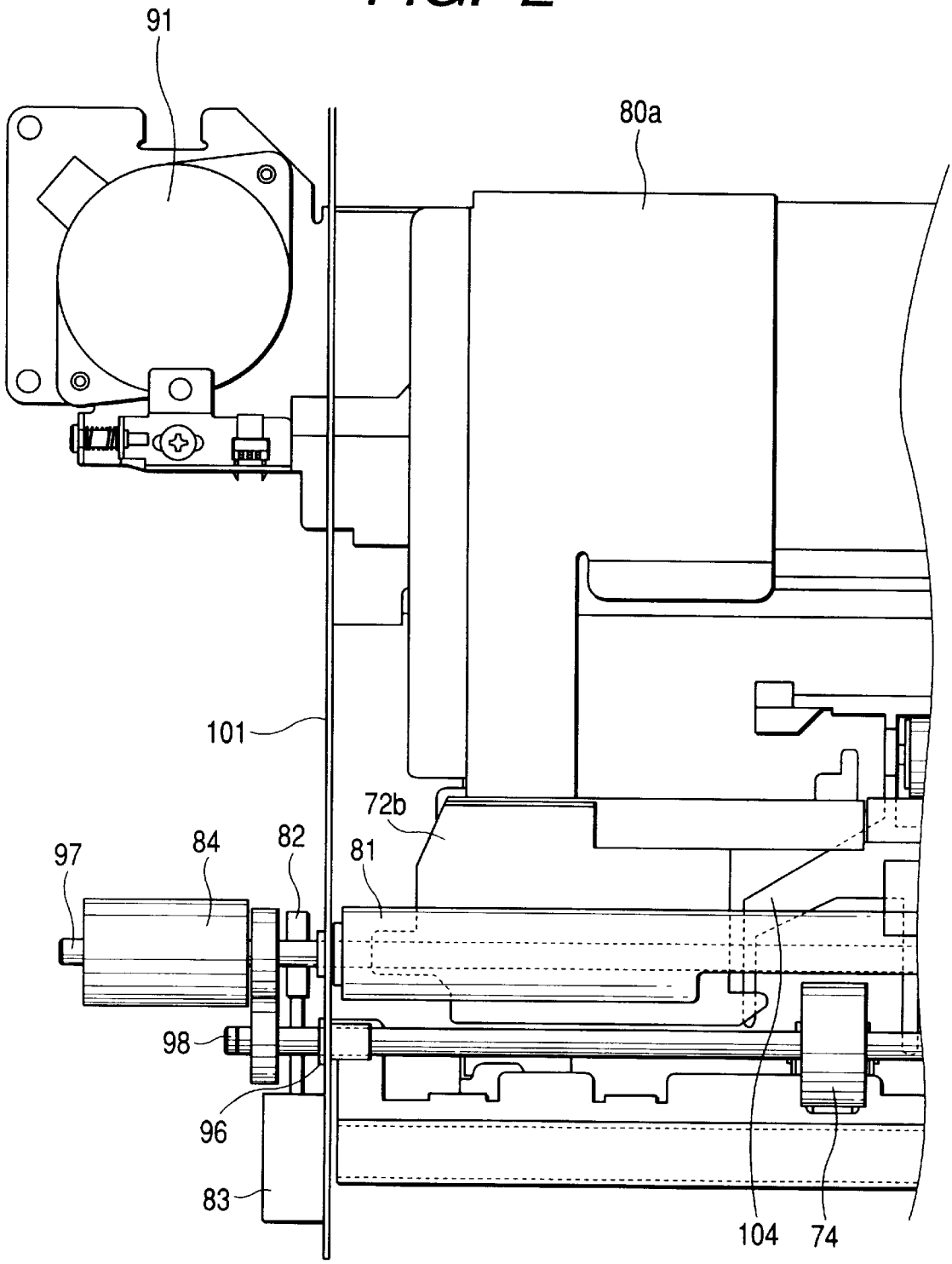
FIG. 2 is a plan view showing the left half of the main portion of the image forming apparatus according to the preferred embodiment.
Figure 3:
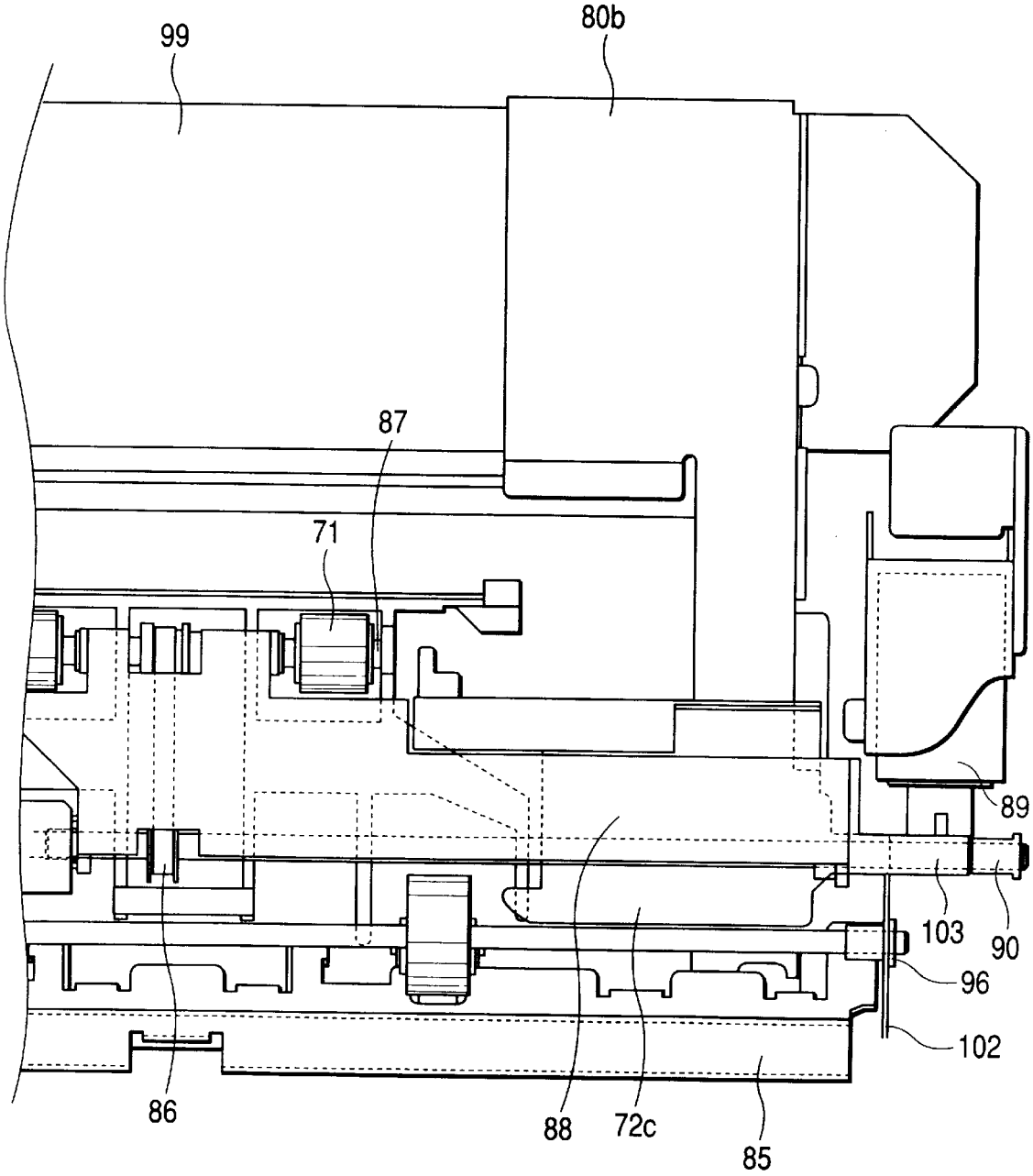
FIG. 3 is a plan view showing the right half of the main portion of the image forming apparatus according to the preferred embodiment.

In FIGS. 2 and 3, rotation of a shaft 98 is transmitted to the drive shaft 97 through a clutch 84 and a guide cam 81 can be engaged by and disengaged from the movable sheet guide to change the posture of the latter. A link 82 engaged by the guide cam can be pulled by a cam solenoid 83. An arm plate lever 103 is engaged by the arm plate 88 and is fit on the drive shaft 97. The arm plate lever can be pulled by an arm solenoid 89. Movable side sheet guides 72*b*, 72*c* rested on the movable sheet guide can be shifted in a vertical direction.

Figure 4:
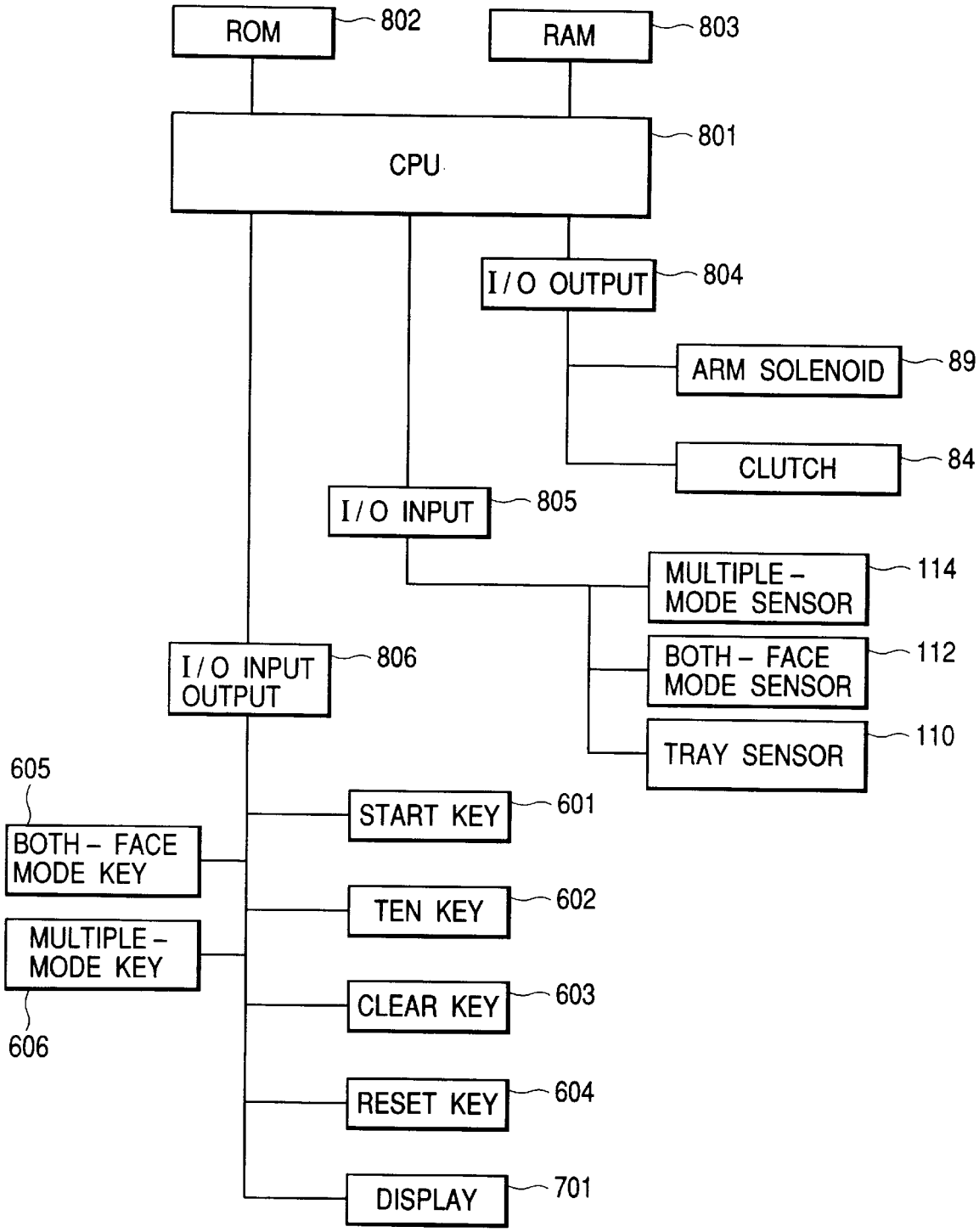
FIG. 4 is a block diagram showing the preferred embodiment.

FIG. 4 is a block diagram of a control device according to the preferred embodiment, in which a CPU 801 serves to control the entire image forming apparatus (copying machine). Control sequence (control program) shown in FIGS. 5 to 7 (illustrating flow charts) is stored in a read-only memory (ROM) 802, and the CPU 801 controls various devices connected to the CPU through a bus, in accordance with the control sequence stored in the ROM 802. A random access memory 803 serves to store data and is used as a work record area.

An interface (I/O) 804 serves to output control signals from the CPU 801 to loads such as the clutch 84 and the like, an interface 805 serves to receive signals from the multi-mode sensor 114 and the like and to send such signals to the CPU 801, and an interface 806 serves to control input and output of a start key 601, a display 701 and the like. Integrated circuits for input/output circuit ports are used as these interfaces 804, 805 and 806.

Figure 6:
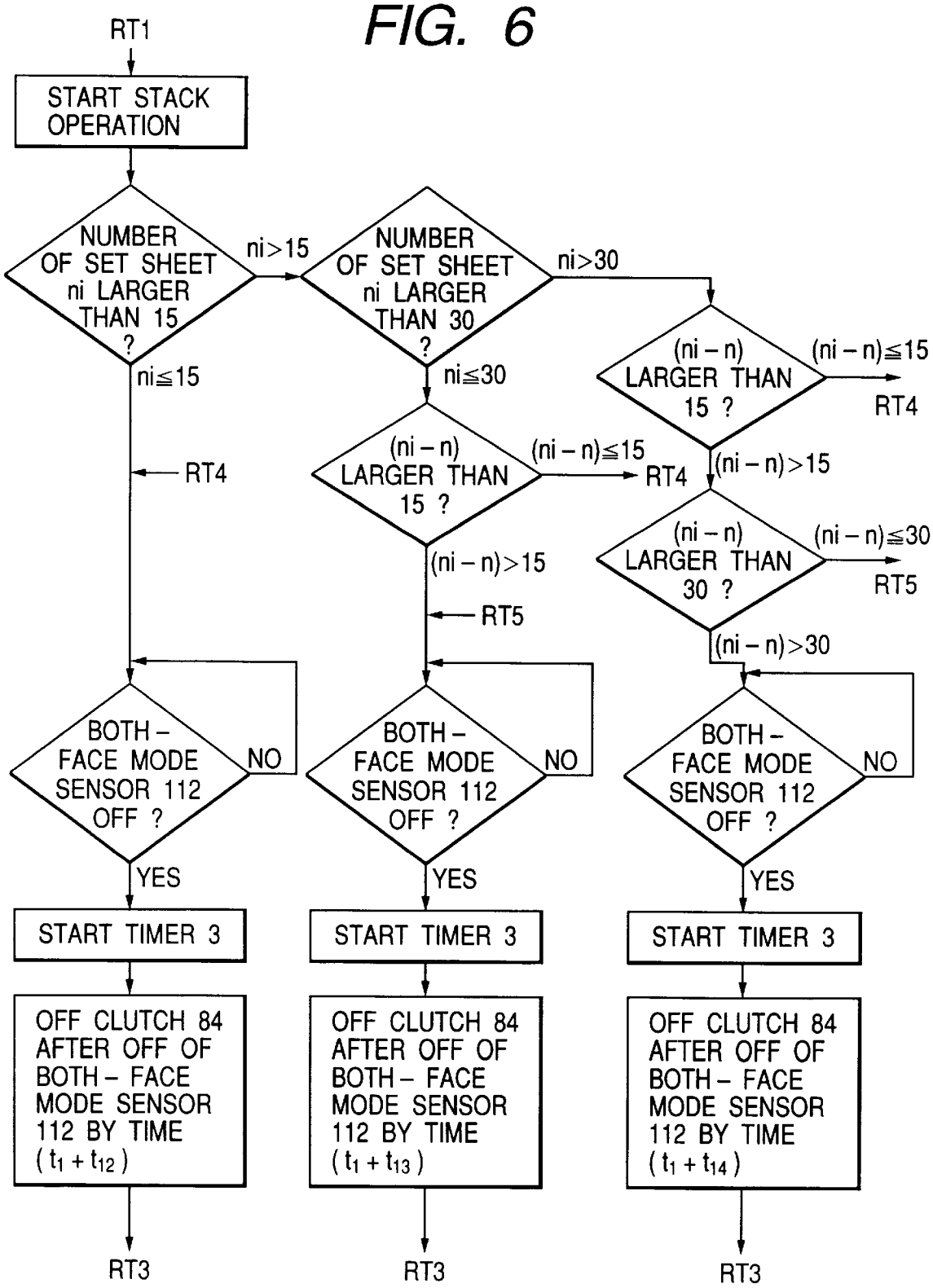

Regarding the above-mentioned arrangement, a stacking operation in a both-face mode will be explained with reference to FIGS. 5 and 6. When a power supply of the image forming apparatus is turned ON, a value a in the RAM 803 shown in FIG. 4 is cleared. Thereafter, when a both-face mode key 605 shown in FIG. 4 is turned ON by an operation portion (not shown), the both-face mode is recorded in the RAM through the CPU. If no mode key is depressed, a one-face mode initially set in the RAM is selected. Further, the number of set sheets N input by a ten key 602 is also recorded in the RAM. If the ten key is not depressed, the number of set sheets "1" initially set in the RAM is selected. The number of set sheets n recorded at this stage is hereinafter referred to as "$n_i$".

When the start key 601 is depressed by the operator, it is judged whether the one-face mode is desired or not. If affirmative, the one-face copy is performed, and then the operation is finished. If negative, it is judged whether the both-face mode is desired or not. If negative, the program goes to RT12 (routine of which will be described later). If the both-face mode is desired, it is judged whether the value a in the RAM was cleared or not. In this case, because of a first copy, the value a has been cleared. Then, the stacking operation is started.

Explaining the stacking operation, when the arm solenoid 89 (FIG. 3) is turned ON, the arm plate 88 is lifted with respect to the bottom plate 76 via the arm plate lever 103, as shown in FIG. 1. As a result, the sheet supply roller shaft 87 and the sheet supply roller 71 are also lifted. Since the sheet supply roller shaft 87 is fitted in the arm plate 88 through a longitudinal hole, equalization is permitted, and, when the arm plate 88 is lowered, since the arm plate is rested on the central portion of the sheet supply roller shaft 87, the sheet supply roller 71 is uniformly urged against the bottom plate 76 with constant or uniform pressure, thereby reducing the skew-feed of the sheet.

The movable sheet guide 104 is fit on the sheet supply roller shaft 87. The pressurizing lever 94 abuts against an end of the movable sheet guide 104 to bias the movable sheet guide in the anti-clockwise direction around the sheet supply roller shaft, with the result that the movable sheet guide is brought to a waiting condition with the right end thereof lifted.

The movable side sheet guides 72*b*, 72*c* resting on the movable sheet guide 104 are also lifted to their waiting positions. The movable side sheet guides 72*b*, 72*c* are pivotally supported by bosses of the arm plate 88.

In this condition, as shown in FIG. 1, a first sheet conveyed by the U-turn roller 74 is discharged onto the bottom plate 76 by the discharge sub-roller 75. Thereafter, side guides 80*a*, 80*b* separated from each other by a distance greater than a width of the sheet are moved to approach to each other till the sheet size. When a predetermined time period is elapsed after a trail end of the sheet leaves the both-face mode sensor 112, the arm solenoid 89 is turned OFF, with the result that the sheet supply roller 71 is lowered onto the sheet by its own weight and is stopped there with the sheet pinched between the sheet supply roller and the bottom plate 76. When a predetermined time period is elapse after the arm solenoid 89 is turned OFF, the clutch 84 is turned ON to drive the sheet supply roller 71, thereby conveying the sheet toward a shutter 93. The conveyed sheet is pinched between the movable sheet guide 104 disengaged from the pressurizing lever 94 (to be brought to a posture shown in FIG. 9) due to the lowering of the sheet supply roller 71 and the bottom plate 76 and then is detected by the tray sensor 110.

As shown in FIG. 5, after the sheet is detected by the tray sensor 110, a timer 2 is started. When a time period $t_{11}$ [seconds] is elapsed, the clutch is turned OFF to stop the sheet supply roller 71. In this condition, the sheet abuts against the shutter 93. In this way, the sheet can be stopped immediately after the sheet abuts against the shutter 93, without being influenced by unevenness in a dropped position of the sheet and unevenness in a conveying distance of the sheet supply roller through which the dropped sheet is conveyed up to the tray sensor 110 by the sheet supply roller 71. In place of the above-mentioned method, when the time period $t_{11}$ [seconds] is elapsed after the sheet is detected by the tray sensor 110, the arm solenoid 89 may be turned ON to separate the sheet supply roller 71 from the sheet thereby to stop the sheet urged against the shutter 93. In this case, the same effect as the above-mentioned method can be achieved.

Incidentally, in the above-mentioned sheet stacking process, as shown in FIG. 5, a timer 1 is started immediately after the trail end of the sheet leaves the both-face mode sensor 112 to turn OFF the latter, and the timer is stopped immediately after the tray sensor 110 is turned ON. A time period $t_1$ counted by the timer in this way is recorded in the RAM 803 as $a=t_1$.

Next, an operation after one sheet is stacked will be explained. Whenever the stacking of one sheet is completed, the number of set copies n initially recorded in the RAM is subtracted by "1". If the value (n−1) becomes zero, the value a in the RAM is cleared and the stacking operation is finished. Then, the next sheet supplying operation is started automatically or by using the start key 601. If the value (n−1) is not zero, since "$a=t_1$" is recorded in the RAM 803, in accordance with this fact, the program goes to RT1. And, as shown in FIG. 6, similar to the stacking of the first sheet, the stacking operation is started.

Then, it is judged whether the number of set sheets $n_i$ is smaller than 15 ($n_i \leqq 15$). If $n_i \leqq 15$, at a same time when the trail end of the sheet being stacked leaves the both-face mode sensor 112 to turn OFF the latter, a timer 3 is started, and, regarding the value "$a=t_1$" recorded in the RAM 803, after a time period $(t_1+t_{12})$ [seconds] is elapsed, the clutch 84 is turned OFF. In the following routine, a time period from when the both-face mode sensor is turned OFF to when the clutch 84 is turned OFF is referred to as "$T_1$". Thereafter the program goes to RT3 where the value n is subjected by "1" as shown in FIG. 5. Then the program goes to RT1 again, where the stacking operation is repeated until the value becomes zero (n=0).

Regarding a relation between $t_{11}$ and $t_{12}$, if a friction force between the bottom plate 76 and the sheet is smaller than a friction force between the sheets, since the sheet conveying speed of the sheet supply roller 71 for conveying the first sheet is greater than the sheet conveying speed of the sheet supply roller 71 for conveying second and other sheets, it is desirable that $t_{11}$ is smaller than $t_{12}$ ($t_{11}<t_{12}$). If the friction force between the bottom plate 76 and the sheet is greater than the friction force between the sheets, $t_{11}>t_{12}$ is desirable for the same reason. If the friction force between the bottom plate 76 and the sheet is substantially the same as the friction force between the sheets, $t_{11}=t_{12}$ is desirable.

Next, a case of $15<n_i \leqq 30$ in FIG. 6 will be explained. In such a case, when it is judged as 15<n and it is judged as $n_i \leqq 30$, it is judged whether $(n_i-n)$ is greater than 15 $(n_i-n)>15$. "$(n_i-n)>15$" means the fact that sixteen or more sheets were already stacked on the intermediate tray, since the value is subtracted by "1" whenever each sheet is stacked on the intermediate tray. Thus, until the number of the stacked sheets becomes 15, since $(n_i-n) \leqq 15$ is maintained and the program goes to RT4, after a time period $T_1(=t_1+t_{12})$ [seconds] is elapsed, the clutch 84 is turned OFF. Explaining a further routine until 15 sheets are reached, after the program goes to RT3, the value n is subtracted by "1", and then the program goes to RT1 again, where, after the time period $T_1(=t_1+t_{12})$ [seconds] is elapsed, the clutch 84 is turned OFF. By repeating such operations, the stacking operation is repeated. Regarding sixteenth or other sheets, since $(n_i-n)>15$, an operation in which the clutch 84 is turned OFF after a time period $T_1(=t_1+t_{13})$ [seconds] is elapsed is repeated. During this routine, if the value becomes zero, the operation is finished as mentioned above.

Next, a case of $n_i>30$ will be explained. In such a case, first of all, when it is judged as $n_i>15$ and then it is judged as $n_i>30$, it is judged whether $(n_i-n)$ is greater than 15 $(n_i-n)>15$.

As mentioned above, until the number of the stacked sheets becomes 15, since it is judged as $(n_i-n) \leqq 15$, the program goes to RT4. A further operation until 15 sheets are stacked is the same as the operation regarding $15<n_i \leqq 30$. From sixteen-th sheet to thirty-th sheet, since it is judged as $(n_i-n)>15$ and then it is judged as $(n_i-n) \leqq 30$, the program goes to RT5. A further operation until 30 sheets are stacked is the same as the operation until sixteen-th and other sheets are stacked in the case of $15<n_i \leqq 30$. Regarding thirty-first and other sheets, since it is judged as $(n_i-n)>15$ and then it is judged as $(n_i-n)>30$, the operation in which the clutch 84 is turned OFF after a time period $T_1(=t_1+t_{14})$ [seconds] is elapsed is repeated.

Next, a relation between $t_{12}$ and $t_{13}$ and $t_{14}$ will be explained.

Figure 13A:
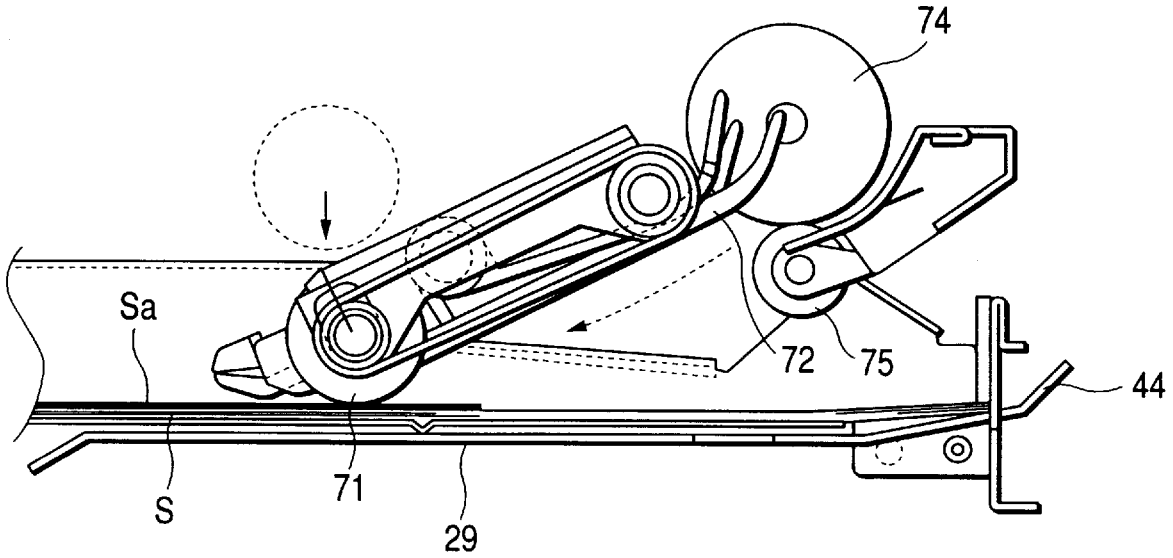
FIGS. 13A and 13B are views showing the fact that a position of the sheet discharged onto the intermediate tray is changed in accordance with the number of sheets stacked on the intermediate tray.
Figure 13B:
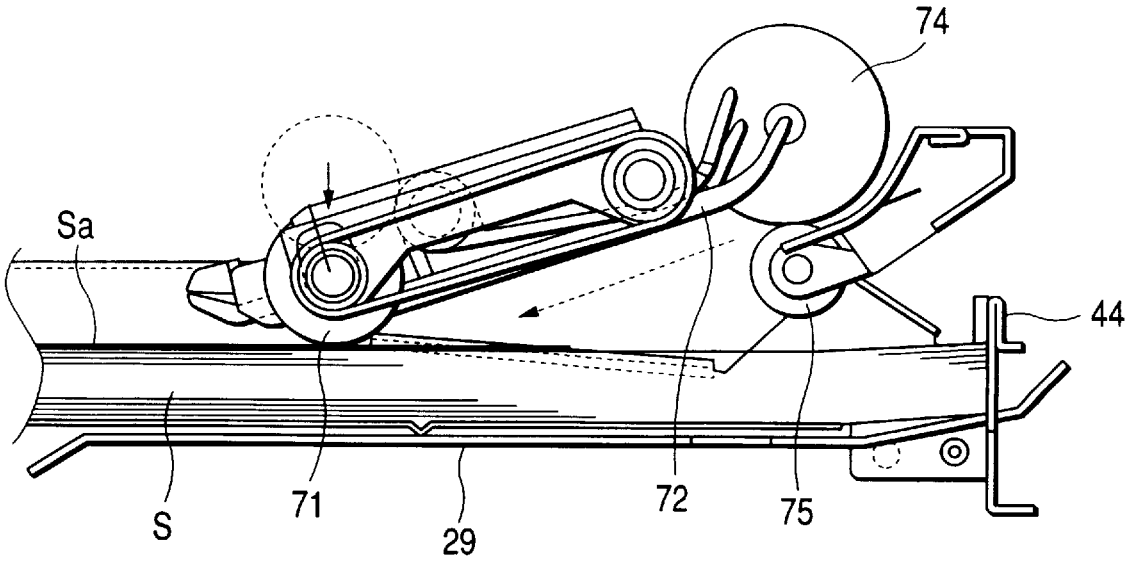

As shown in FIG. 13A, if the number of the stacked sheets is small, a time period from when the arm solenoid 89 is turned OFF to when the sheet supply roller 71 is dropped on the sheet stack becomes long. Thus, in the illustrated method in which a sheet Sa entered onto the intermediate tray is stopped by pinching the sheet between the sheet supply roller 71 and the sheet stack S, the sheet Sa is flying far. On the other hand, as shown in FIG. 13B, if the number of the stacked sheets is great, the sheet Sa is flying not so far. Accordingly, in the above-mentioned both-face copy mode, it is desirable that the timing for turning OFF the clutch 84 is more delayed the smaller the number of the stacked sheets. That is to say, $t_{12}>t_{13}>t_{14}$ is desirable.

Figure 7:
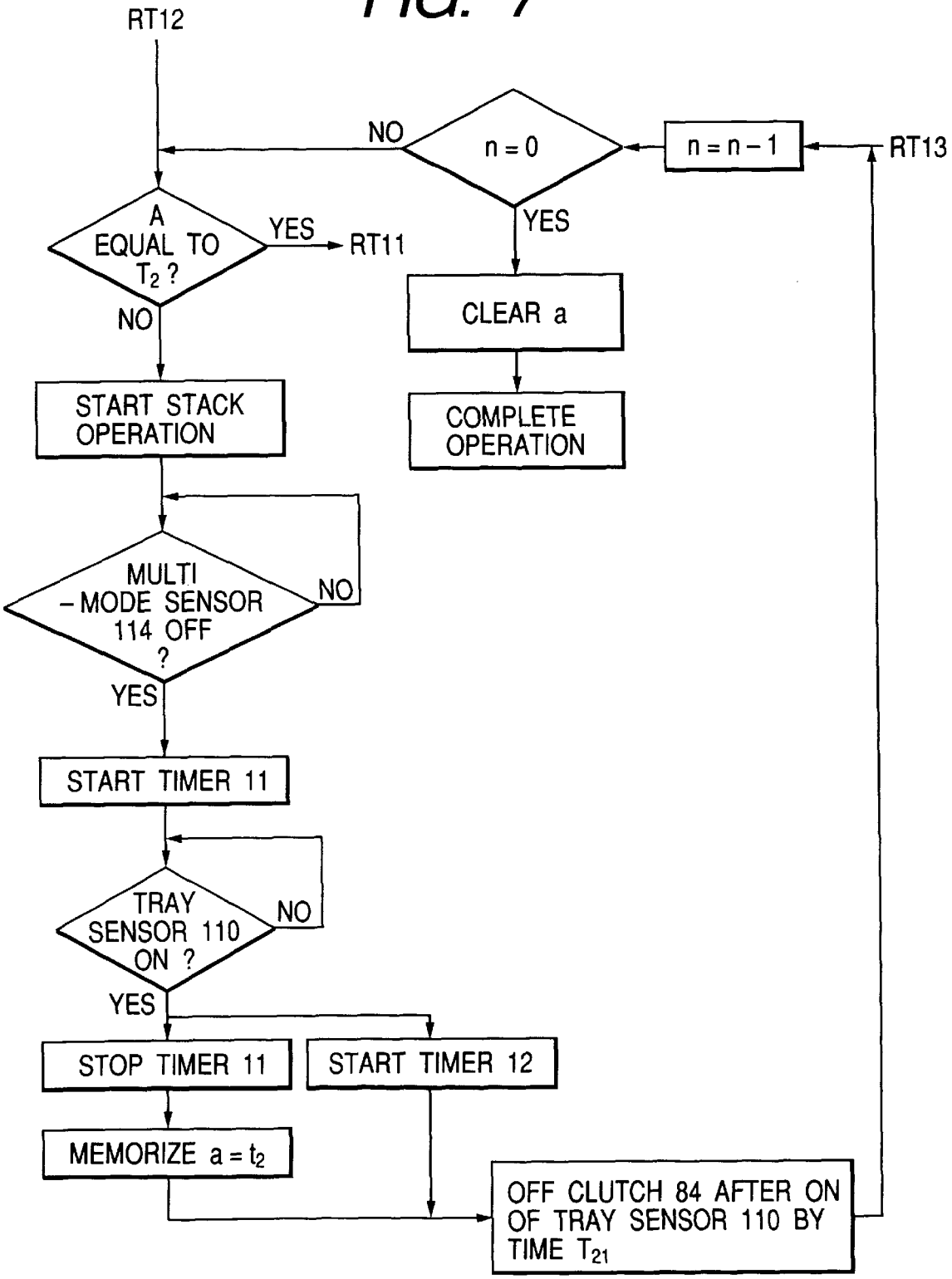
Figure 9:
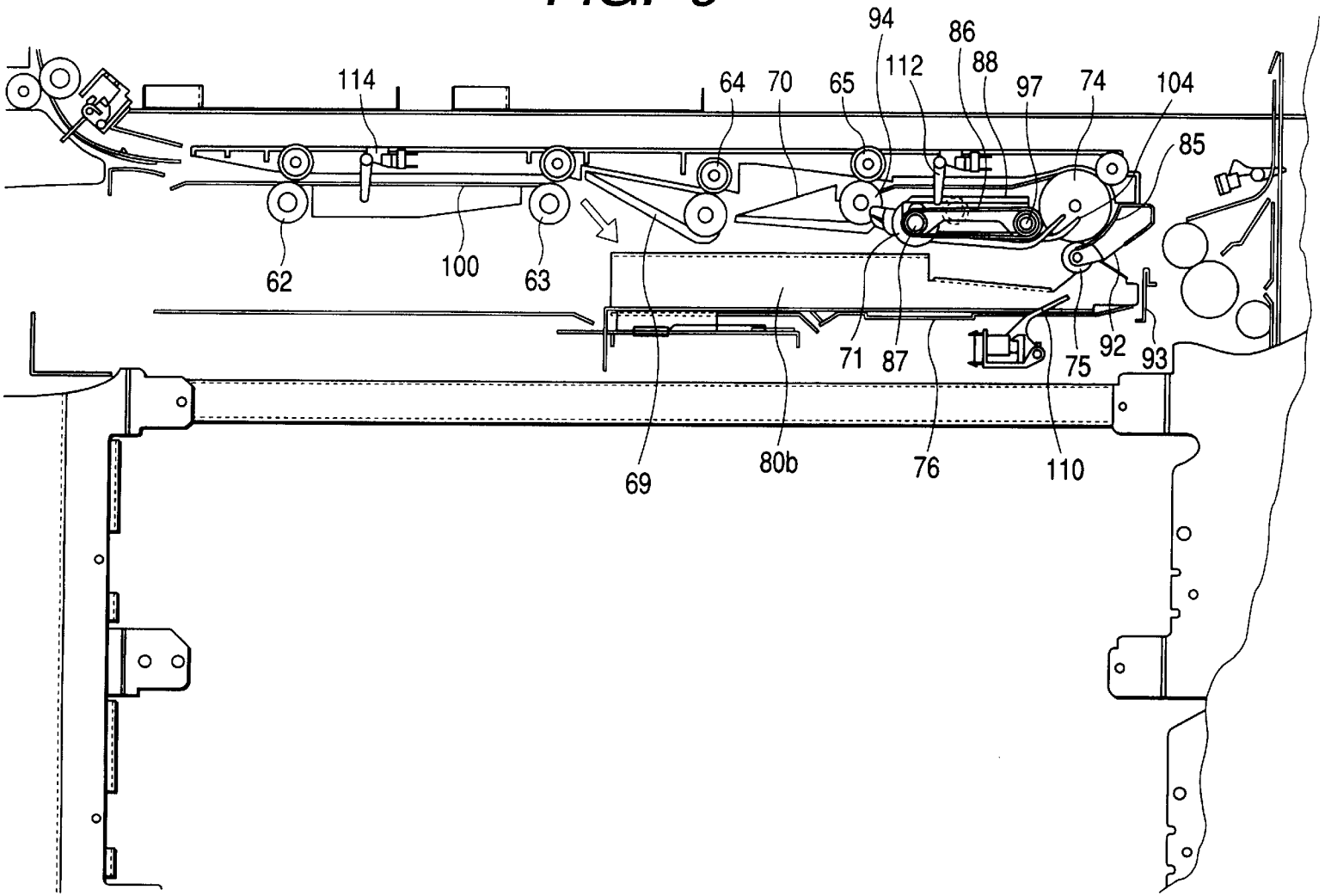
FIG. 9 is an elevational sectional view showing the image forming apparatus in a multi-mode.
Figure 10:
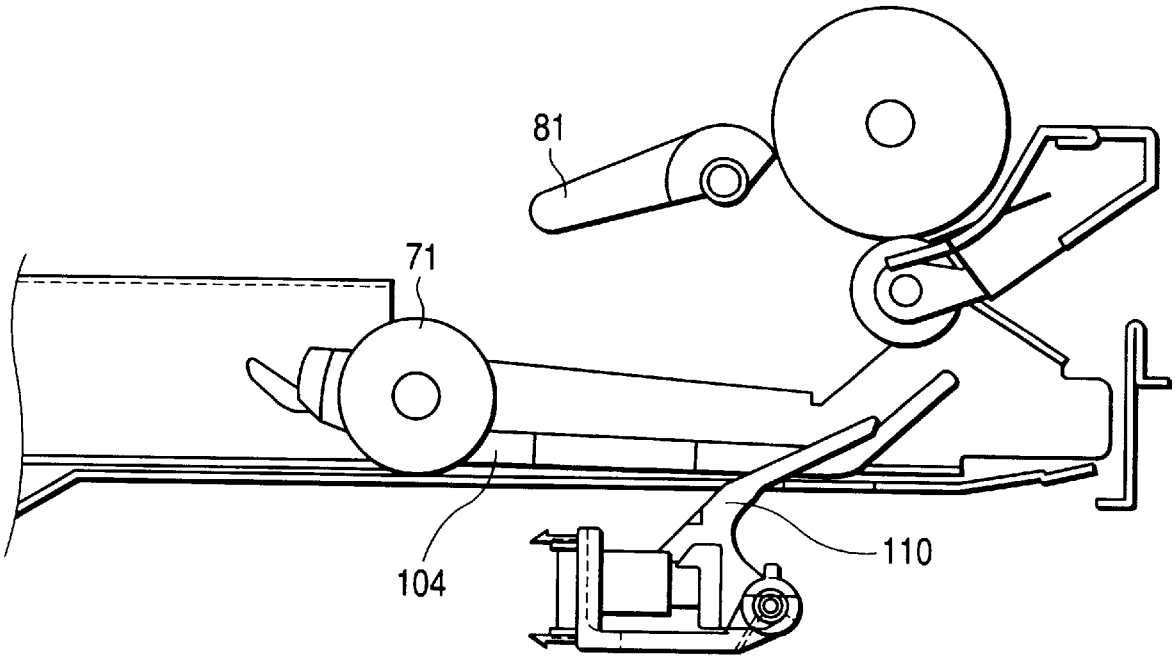
FIG. 10 is an elevational sectional view showing the image forming apparatus in a sheet sweeping operation.

Next, the stacking operation in the multi-mode will be explained with reference to FIGS. 5, 6 and 7. Since the greater part of the operation is the same as the stacking operation in the both-face mode, only differences will be described. After the power supply is turned ON, the same program as that in the both-face mode is carried out until it is judged whether the both-face mode is desired. After it is judged that the both-face mode is not desired, the program goes to RT12. Thereafter, although the program follows the same sequence as that in the both-face mode, after the stacking operation is started, as shown in FIG. 9, the flapper 69 or 70 is opened in accordance with the sheet size, and the sheet is introduced onto the intermediate tray as shown by the arrow. Then, immediately after the trail end of the sheet leaves the multi-mode sensor 114 to turn OFF the latter, a timer 11 is started, and the timer 11 is stopped immediately after the tray sensor 110 is turned ON. A time period $t_2$ counted by the timer in this way is recorded in the RAM 803. A timer 12 is started immediately after the tray sensor 110 is turned ON, and, after a predetermined time period $t_{21}$ is elapsed, the clutch 84 is turned OFF, thereby abutting the sheet against the shutter 93 and stopping the sheet there.

Figure 8:
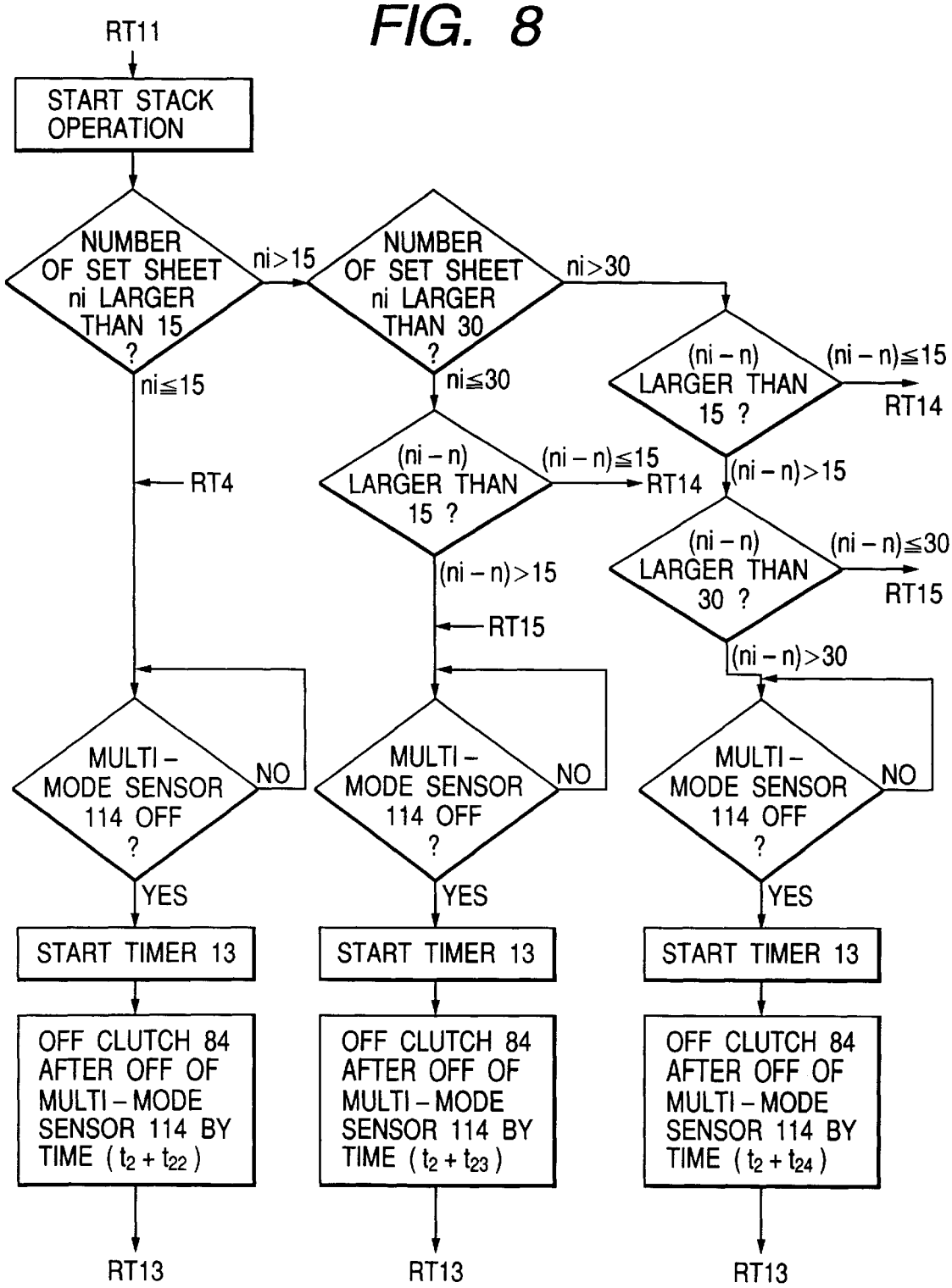

Thereafter, as is in the both-face mode, the value n is subtracted by "1". If (n−1) becomes zero, the value a in the RAM 803 is cleared and the stacking operation is finished. If (n−1) is not zero, since the value $a=t_2$is recorded, in accordance with this fact, the program goes to RT11. And, as shown in FIG. 8, similar to the stacking of the first sheet, the stacking operation is started. Thereafter, if $n_i<15$, at a same time when the trail end of the sheet being stacked leaves the multi-mode sensor 114 to turn OFF the latter, a timer 13 is started, and, regarding the value "$a=t_2$" recorded in the RAM 803, after a time period $(t_2+t_{22})$ [seconds] is elapsed, the clutch 84 is turned OFF.

In the following routine, a time period from when the multi-mode sensor 114 is turned OFF to when the clutch 84 is turned OFF is referred to as "$T_2$". Thereafter, the program goes to RT13 where the value n is subtracted by "1" as shown in FIG. 7. Then, the program goes to RT11 again, where the stacking operation is repeated until the value n becomes zero (n=0).

Regarding a relation between $t_{21}$ and $t_{22}$, if a friction force between the bottom plate 76 and the sheet is smaller than a friction force between the sheets, since the sheet conveying speed of the sheet supply roller 71 for conveying the first sheet is greater than the sheet conveying speed of the sheet supply roller 71 for conveying second and other sheets, it is desirable that $t_{21}$ is smaller than $t_{22}$ ($t_{21}>t_{22}$). If the friction force between the bottom plate 76 and the sheet is greater than the friction force between the sheets $t_{21}>t_{22}$ is desirable for the same reason. If the friction force between the bottom plate 76 and the sheet is substantially the same as the friction force between the sheets, $t_{21}=t_{22}$ is desirable.

Next, a case of $15<n_i\leqq 30$ in FIG. 8 will be explained. In such a case, when it is judged as $15<n_i$ and then it is judged as $n_i\leqq 30$, it is judged whether $(n_i-n)$ is greater than 15 $(n_i-n)>15$. "$(n_i-n)>15$" means the fact that sixteen or more sheets were already stacked on the intermediate tray, since the value is subtracted by "1" whenever each sheet is stacked on the intermediate tray. Thus, until the number of the stacked sheets becomes 15, since $(n_i-n)\leqq 15$ is maintained and the program goes to RT14, after a time period $T_2(=t_2+t_{22})$ [seconds] is elapsed, the clutch 84 is turned OFF. Explaining a further routine until 15 sheets are reached, after the program goes to RT13, the value n is subtracted by "1", and then the program goes to RT11 again, where, after the time period $T_2(=t_2+t_{22})$ [seconds] is elapsed, the clutch 84 is turned OFF. By repeating such operations, the stacking operation is repeated. Regarding sixteenth or other sheets, since $(n_i-n)>15$, an operation in which the clutch 84 is turned OFF after a time period $T_2(=t_2+t_{23})$ [seconds] is elapsed is repeated. During this routine, if the value n becomes zero, the operation is finished, as mentioned above.

Next, a case of $n_i>30$ will be explained. In such a case, first of all, when it is judged as $n_i>15$ and then it is judged as $n_i>30$, it is judged whether $(n_i-n)$ is greater than 15 $(n_i-n)>15$.

As mentioned above, until the number of the stacked sheets becomes 15, since it is judged as $(n_i-n)\leqq 15$, the program goes to RT14. A further operation until 15 sheets are stacked is the same as the operation regarding $15<n_i\leqq 30$. From sixteen-th sheet to thirty-th sheet, since it is judged as $(n_i-n)>15$ and then it is judged as $(n_i-n)\leqq 30$, the program goes to RT15. A further operation until 30 sheets are stacked is the same as the operation until sixteen-th and other sheets are stacked in the case of $15<n_i\leqq 30$. Regarding thirty-first and other sheets, since it is judged as $(n_i-n)>15$ and then it is judged as $(n_i-n)>30$, the operation in which the clutch 84 is turned OFF after a time period $T_2(=t_2+t_{24})$ [seconds] is elapsed is repeated.

Next, a relation between $t_{22}$ and $t_{23}$ and $t_{24}$ will be explained.

As shown in FIG. 9, if the number of the stacked sheets is small, a time period from when the arm solenoid 89 is turned OFF to when the sheet supply roller 71 is dropped on the sheet stack becomes long.

Thus, in the illustrated method in which a sheet entered onto the intermediate tray is stopped by pinching the sheet between the sheet supply roller 71 and the sheet stack, the sheet is flying far. Accordingly, in the above-mentioned multi-copy mode, it is desirable that the timing for turning OFF the clutch 84 is more hastened the smaller the number of the stacked sheets.

That is to say, the relation of $t_{22}<t_{23}<t_{24}$ is desirable.

Regarding the routines in the both-face mode and the multi-mode, while an example that the time periods $T_1$, $T_2$ are changed in accordance with the number of the already stacked sheets (smaller than 15 and greater than 16, and, smaller than 30 and greater than 31) was explained, the time periods $T_1$, $T_2$ may be changed in accordance with any number of the stacked sheets other than the above values. Further, regarding the sheet supply roller 71, while an example that the clutch 84 is turned OFF in order to stop the swept sheet was explained, the sheet urged against the shutter may be stopped by separating the sheet supply roller 71 from the sheet by lifting the arm plate 88 by turning ON the arm solenoid 89.

As mentioned above, by reflecting the sheet conveying times $t_1$, $t_2$ for the first sheet in the conveyance of the second and other sheets, the unevenness in the dropped position of the sheet due to difference (between apparatuses) in time period from when the arm solenoid 89 is turned OFF to when the sheet supply roller 71 is dropped by the predetermined amount, time lapse change, environmental change, kind of the sheet and/or curl and resiliency of the sheet, and the unevenness in the sheet conveying distance due to the difference (between apparatuses) in diameter of the sheet supply roller 71, the difference (between apparatuses) in coefficient of friction and time lapse change thereof can be suppressed, and, thus, the influence of such unevenness acting upon the stopped position of the sheet after sheet supply can be eliminated.

Further, by changing the sheet sweeping amount of the sheet supply roller 71 in accordance with the number of the already stacked sheets, the influence of the unevenness (in the dropped position of the sheet due to the change in the number of the stacked sheets) acting upon the stopped position of the sheet after sheet supply can be eliminated.

What is claimed is:

1. An image forming apparatus comprising:

re-supply stacking means for temporarily stacking a sheet so that the sheet on one surface of which an image is formed by an image forming means is re-supplied to said image forming means;

sheet convey means for reversing a front surface and a rear surface of a sheet and conveying the sheet to said re-supply stacking means;

shift means for shifting the sheet discharged from said sheet convey means and stacked on said re-supply stacking means to abut the sheet against a regulation means for regulating a position of the sheet; and control means for controlling so as to change a shift amount by said shift means.

2. An image forming apparatus according to claim 1, wherein said shift means abuts against the sheet being discharged from said sheet convey means to said re-supply stacking means to forcibly drop the sheet onto said re-supply stacking means to thereby shift the sheet toward said regulating means after the dropping thereof.

3. An image forming apparatus according to claim 2, further comprising a sheet passage detection means for detecting passage of the sheet being conveyed by said sheet convey means, and a sheet stack detection means for detecting the fact that the sheet is stacked on said re-supply stacking means, wherein, when a plurality of sheets are stacked on said re-supply stacking means, said control means measures a time period through which a sheet to be firstly stacked is shifted from said sheet passage detection means to said sheet stack detection means to cause said shift means to thereby shift the sheet after second sheet on the basis of the measured time period.

4. An image forming apparatus according to claim 3, wherein, when the sheet is one to be firstly stacked, said shift means further shifts the sheet to be abutted against said regulating means by a predetermined time period after the dropped sheet being shifted by said shift means toward said regulating means is detected by said sheet stack detection means, and, when the sheet is one after the second sheet, said shift means shifts the sheet to be abutted against said regulating means by a predetermined time period after said measured time period is elapsed.

5. An image forming apparatus according to claim 4, wherein said control means changes said predetermined time period in accordance with the number of sheets stacked on said re-supply stacking means.

6. An image forming apparatus according to claim 5, wherein said control means lengthens said predetermined time period as a distance between the position of the sheet dropped on said re-supply stacking means and said regulating means is increased.

7. An image forming apparatus according to claim 6, wherein said control means controls so that said predetermined time period is shortened as the number of sheets stacked on said re-supply stacking means is increased.

8. An image forming apparatus according to claim 7, wherein the number of sheets stacked on said re-supply stacking means is divided into plural steps to change said predetermined time period in every step.

9. An image forming apparatus according to claim 1, wherein said shift means is a sheet supply rotary member, and the shift amount of the sheet is changed in accordance with ON/OFF of transmission of rotation to said sheet supply rotary member, when said sheet supply rotary member abuts against the sheet.

10. An image forming apparatus according to claim 1, wherein said shift means is a sheet supply rotary member, and the shift amount of the sheet is changed in accordance with abutment/non-abutment between said sheet supply rotary member and the sheet.

11. An image forming apparatus according to claim 10, wherein said sheet supply rotary member is pivotally supported to change the time period in which said sheet supply rotary member is engaged by or disengaged from the sheet by rocking thereof by means of a drive means.

12. An image forming apparatus according to claim 1, wherein said re-supply stacking means has a horizontally disposed stacking tray, and said shift means has a roller for shifting the sheet discharged on said stacking tray toward said regulating means along an upper surface of said stacking tray.

* * * * *

UNITED STATES PATENT AND TRADEMARK OFFICE

CERTIFICATE OF CORRECTION

PATENT NO. : 6,085,065

DATED : July 4, 2000

INVENTOR(S): EIICHI ANDO

It is certified that error appears in the above-identified patent and that said Letters Patent is hereby corrected as shown below:

COLUMN 3:
Line 5, "regist" should read --register--; and
Line 37, "regist" should read --register--.

COLUMN 6:
Line 66, "elapse" should read --elapsed--.

COLUMN 9:
Line 15, "$n_i < 15$," should read --$n_i \leq 15$,--.

Signed and Sealed this

Tenth Day of April, 2001

*Attest:*

Nicholas P. Godici

NICHOLAS P. GODICI

*Attesting Officer*

*Acting Director of the United States Patent and Trademark Office*